US006586363B2

(12) United States Patent
Loccufier et al.

(10) Patent No.: US 6,586,363 B2
(45) Date of Patent: Jul. 1, 2003

(54) THERMOGRAPHIC RECORDING MATERIAL WITH IMPROVED IMAGE TONE

(75) Inventors: Johan Loccufier, Zwijnaarde (BE); Ivan Hoogmartens, Wilrijk (BE)

(73) Assignee: AGFA-Gevaert (BE)

( * ) Notice: Subject to any disclaimer, the term of this patent is extended or adjusted under 35 U.S.C. 154(b) by 64 days.

(21) Appl. No.: 09/995,281

(22) Filed: Nov. 27, 2001

(65) Prior Publication Data

US 2002/0107146 A1 Aug. 8, 2002

Related U.S. Application Data

(60) Provisional application No. 60/257,230, filed on Dec. 21, 2000.

(30) Foreign Application Priority Data

Nov. 30, 2000 (EP) ..... 00204255

(51) Int. Cl.[7] ..... B41M 5/30

(52) U.S. Cl. ..... 503/201; 503/209; 503/212

(58) Field of Search ..... 503/209, 201, 503/212

(56) References Cited

U.S. PATENT DOCUMENTS

| | | | |
|---|---|---|---|
| 3,218,166 | A | 11/1965 | Reitter |
| 3,547,648 | A | 12/1970 | Sagawa |
| 4,013,473 | A | 3/1977 | Willems et al. |
| 5,672,560 | A | 9/1997 | Rush |

FOREIGN PATENT DOCUMENTS

| | | |
|---|---|---|
| GB | 1410991 | 10/1975 |
| WO | WO 97/11407 | 3/1997 |
| WO | WO 97/34196 | 9/1997 |

OTHER PUBLICATIONS

Search Report for EP 00 20 4255 dated Jun. 7, 2001.

*Primary Examiner*—B. Hamilton Hess
(74) *Attorney, Agent, or Firm*—Leydig, Voit & Mayer, Ltd.

(57) ABSTRACT

A substantially light-insensitive black and white thermographic recording material comprising a thermosensitive element and a support, the thermosensitive element containing at least one substantially light-insensitive organic silver salt, an organic reducing agent therefor in thermal working relationship therewith, an image tone stabilizer and a binder, wherein the image tone stabilizer is a compound according to formula (I):

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group; $R^2$ is an optionally substituted alkyl, cycloalkyl, heterocyclic, alkaryl, aralkyl, heteroaryl or aryl group; or $R^1$ and $R^2$ together represent the atoms necessary to form a ring structure; and X is hydrogen, an alkali metal ion, an ammonium ion, a phosphonium ion, a sulphonium ion or an alkaline earth ion; and a recording process therefor.

8 Claims, No Drawings

THERMOGRAPHIC RECORDING MATERIAL WITH IMPROVED IMAGE TONE

The application claims the benefit of U.S. Provisional Application No. 60/257,230 filed Dec. 21, 2000, which is incorporated by reference. In addition, this application claims the benefit of European Application No. 00204255.4 filed Nov. 30, 2000, which is also incorporated by reference.

FIELD OF THE INVENTION

The present invention relates to thermographic recording materials whose prints have improved archival properties.

BACKGROUND OF THE INVENTION

Thermal imaging or thermography is a recording process wherein images are generated by the use of thermal energy. In direct thermal thermography a visible image pattern is formed by image-wise heating of a recording material.

U.S. Pat. No. 5,672,560 discloses a heat-sensitive imaging material comprising: a support and a heat-sensitive imaging layer formed thereon, the imaging layer comprising a color-forming amount of a substantially colorless, finely divided solid noble metal salt of an organic acid; an organic reducing agent that under conditions of heating is capable of a color-forming reaction with said noble metal salt, thereby producing a colored image; an image toning agent; and a stabilizer compound that mitigates the formation of non-imagewise background color in said imaging layer, said stabilizer compound having the formula:

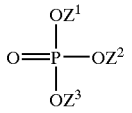

wherein $Z^1$, $Z^2$ and $Z^3$ each independently represents hydrogen, an alkali metal ion, an alkyl group comprising 1 to about 8 carbon atoms, an aralkyl or cycloalkyl group comprising 5 to about 10 carbon atoms, or an alkyl group comprising 6 to about 15 carbon atoms; or $Z^1$ and $Z^2$ together represent a divalent alkaline earth metal ion, a divalent alkylene group comprising 2 to about 8 carbon atoms, or a divalent aryl group comprising 6 to about 30 carbon atoms; with the proviso that, when $Z^1$ and $Z^2$ together do not represent a divalent alkaline earth metal ion, at least one of $Z^1$, $Z^2$ and $Z^3$ represents hydrogen or an alkali metal ion.

In printing with thermographic materials for medical applications for viewing with a light box, optimum diagnosis requires a blue-black image tone so that the higher ability of the human eye to distinguish detail with such image tone can be exploited, thereby improving the diagnostic value of such prints. Such image tone should be independent of the shelf-life of the thermographic recording material prior to printing and also of archival time after printing. Image tone can be assessed on the basis of the L*, a* and b* CIELAB-values as determined by spectrophotometric measurements according to ASTM Norm E179-90 in a R(45/0) geometry with evaluation according to ASTM Norm E308-90. Ingredients are required for substantially light-insensitive thermographic recording materials, which provide a balance of image tone stabilizing properties, enabling prints to be obtained with image tone which after pretempering is less dependent upon storage time prior to printing and to archival time after printing, while exhibiting image tone acceptable for radiologists viewing images in transmission on a light box.

ASPECTS OF THE INVENTION

It is therefore an aspect of the present invention to provide a substantially light-insensitive black and white thermographic recording materials with improved image tone stability not only capable of producing prints with image tone which is less dependent upon storage time prior to printing.

It is therefore a further aspect of the present invention to provide a substantially light-insensitive black and white thermographic recording materials which is less dependent upon archival time after printing, while having an acceptable image tone for medical and graphics images.

Further aspects and advantages of the invention will become apparent from the description hereinafter.

SUMMARY OF THE INVENTION

It has been surprisingly found that substantially light-insensitive thermographic recording materials comprising a thermosensitive element containing particular phosphonic acid derivatives are capable of providing prints whose image tone is less dependent upon storage time prior to printing and is less dependent upon archival time after printing, such a balance of properties combined with acceptable image tone not being provided by prior art thermographic recording materials.

Aspects of the present invention are provided by a substantially light-insensitive black and white thermographic recording material comprising a thermosensitive element and a support, the thermosensitive element containing at least one substantially light-insensitive organic silver salt, an organic reducing agent therefor in thermal working relationship therewith, an image tone stabilizer and a binder, wherein the image tone stabilizer is a compound according to formula (I):

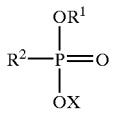

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group; $R^2$ is an optionally substituted alkyl, cycloalkyl, heterocyclic, alkaryl, aralkyl, heteroaryl or aryl group; or $R^1$ and $R^2$ together represent the atoms necessary to form a ring structure; and X is hydrogen, an alkali metal ion, an ammonium ion, a phosphonium ion, a sulphonium ion or an alkaline earth ion.

Further aspects of the present invention are provided by a recording process comprising the steps of: (i) bringing an outermost layer of a thermographic recording material as described above into proximity with a heat source; (ii) applying heat from the heat source imagewise to the thermographic recording material in a substantially water-free condition while maintaining proximity to the heat source to produce an image; and (iii) removing the thermographic recording material from the heat source.

Use of a compound according to formula (I):

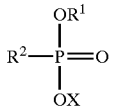

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group; $R^2$ is an optionally substituted alkyl, cycloalkyl, heterocyclic, alkaryl, aralkyl, heteroaryl or aryl group; or $R^1$ and $R^2$ together represent the atoms necessary to form a ring structure; and X is hydrogen, an alkali metal ion, an ammonium ion, a phosphonium ion, a sulphonium ion or an alkaline earth ion; in a substantially light-insensitive thermographic recording material as an image tone stabilizer is also provided by aspects of the present invention.

Further advantages and aspects of the present invention will become apparent from the following description.

DETAILED DESCRIPTION OF THE INVENTION

According to a first aspect of the thermographic recording process, according to the present invention, the heat source is a thermal head.

According to a second aspect of the thermographic recording process, according to the present invention, the heat source is a thin film thermal head.

DEFINITIONS

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

By substantially light-insensitive is meant not intentionally light sensitive.

A fatty acid is an organic monobasic acid of general formula $C_nH_{2n+1}COOH$ derived from the saturated series of aliphatic hydrocarbons, such as palmitic acid, stearic acid, behenic acid and arichidic acid.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Image Tone Stabilizer

According to the present invention a substantially light-insensitive black and white thermographic recording material is provided comprising a thermosensitive element containing at least one substantially light-insensitive organic silver salt, an organic reducing agent therefor in thermal working relationship therewith, an image tone stabilizer and a binder, wherein the image tone stabilizer is a compound according to formula (I):

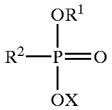

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group; $R^2$ is an optionally substituted alkyl, cycloalkyl, heterocyclic, alkaryl, aralkyl, heteroaryl or aryl group; or $R^1$ and $R^2$ together represent the atoms necessary to form a ring structure; and X is hydrogen, an alkali metal ion, an ammonium ion, a phosphonium ion, a sulphonium ion or an alkaline earth ion.

According to a first aspect of the substantially light-insensitive thermographic recording material, according to the present invention, the substituents for the alkyl, cycloalkyl, heterocyclic, alkaryl, aralkyl, heteroaryl or aryl group representing $R^1$ in formula (I) are: carboxy, carboxyalkyl, alkyl, hydroxy, acyl, heteroaryl, mercapto, acyloxy, alkoxy, aryloxy and oxoamino groups.

According to a second aspect of the substantially light-insensitive thermographic recording material, according to the present invention, the substituents for the alkyl, cycloalkyl, heterocyclic, alkaryl, aralkyl, heteroaryl or aryl group representing $R^2$ in formula (I) are: carboxy, carboxyalkyl, alkyl, hydroxy, acyl, heteroaryl, mercapto, acyloxy, alkoxy, aryloxy and oxoamino groups.

Suitable image tone stabilizing compounds according to the present invention are:

| Image tone stabilizer | Structure |
|---|---|
| ITS-1 | 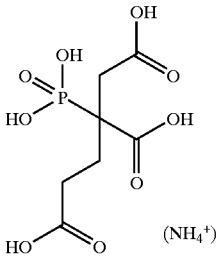 |

-continued
| Image tone stabilizer | Structure |
|---|---|
| ITS-2 | 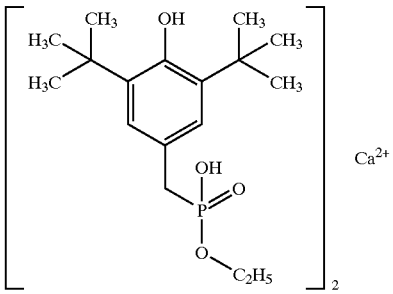 |
| ITS-3 | 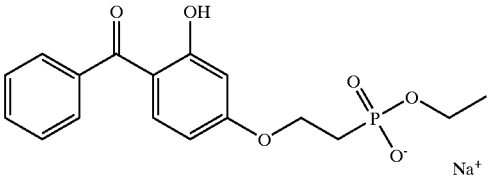 |
| ITS-4 | 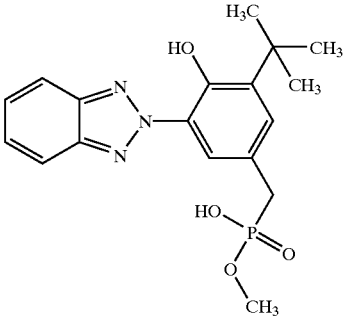 |
| ITS-5 | 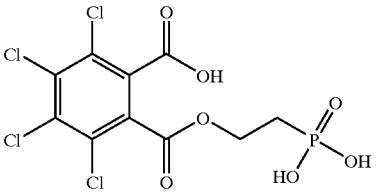 |
| ITS-6 | 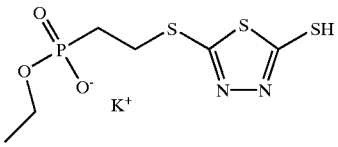 |
| ITS-7 | 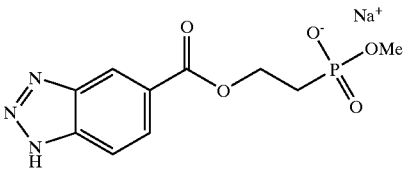 |

-continued
| Image tone stabilizer | Structure |
|---|---|
| ITS-8 | 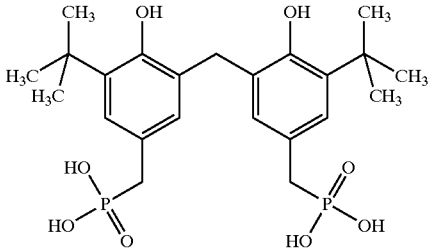 |
| ITS-9 | 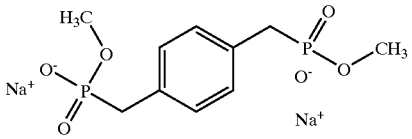 |
| ITS-10 | 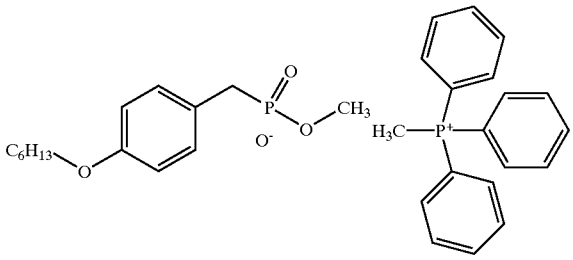 |
| ITS-11 | 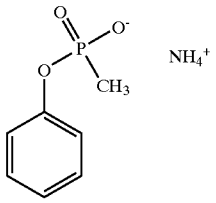 |
| ITS-12 | 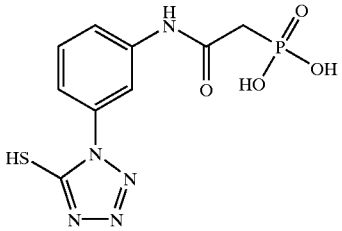 |
| ITS-13 | 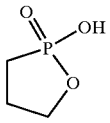 |
| ITS-14 | 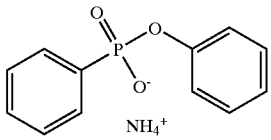 |

-continued

| Image tone stabilizer | Structure |
|---|---|
| ITS-15 | 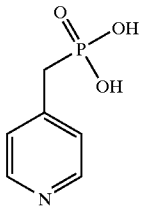 |
| ITS-16 | 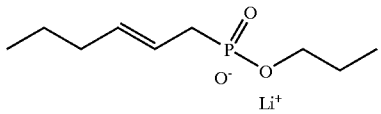 |
| ITS-17 | 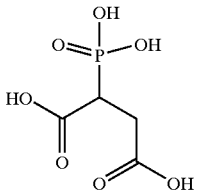 |
| ITS-18 | 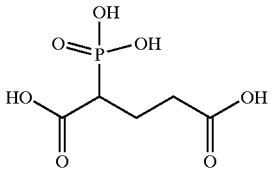 |
| ITS-19 | 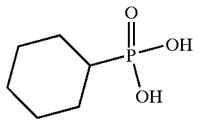 |

According to a third aspect of the substantially light-insensitive thermographic recording material, according to the present invention, the image tone stabilizer is 2-phosphono-1,2,3-propanetricarboxylic acid (ITS-1) or the calcium salt of 4-ethylphosphomethyl-2,5-di-t-butylphenol (ITS-2).

Thermosensitive Element

The thermosensitive element as used herein is that element which contains all the ingredients which contribute to image formation. According to the substantially light-insensitive thermographic recording material of the present invention the thermosensitive element contains a substantially light-insensitive organic silver salt, an organic reducing agent therefor in thermal working relationship therewith, a image tone stabilizer and a binder.

According to a fourth aspect of the substantially light-insensitive thermographic recording material, according to the present invention, the thermosensitive element comprises a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt so that reduction to silver can occur.

Organic Silver Salt

According to a fifth aspect of the substantially light-insensitive thermographic recording material, according to the present invention, the substantially light-insensitive organic silver salt is a substantially light-insensitive silver salt of an organic carboxylic acid.

According to a sixth aspect of the substantially light-insensitive thermographic recording material, according to the present invention, the substantially light-insensitive silver salt is a silver salt of an aliphatic carboxylic acid.

According to a seventh aspect of the substantially light-insensitive thermographic recording material, according to the present invention, the substantially light-insensitive silver salt is a silver salt of a fatty acid.

According to an eighth aspect of the substantially light-insensitive thermographic recording material, according to the present invention, the substantially light-insensitive silver salt is a silver salt of an aliphatic carboxylic acid, wherein the aliphatic carbon chain has between 12 and 30 C-atoms, e.g. silver laurate, silver palmitate, silver stearate, silver hydroxystearate, silver oleate and silver behenate, which silver salts are also called "silver soaps".

According to a ninth aspect of the substantially light-insensitive thermographic recording material, according to the present invention, the substantially light-insensitive silver salt is an organic carboxylic acid as described in GB-P 1,439,478, e.g. silver benzoate.

Combinations of different silver salts of an organic carboxylic acids may also be used in the present invention, as disclosed in EP-A 964 300, herein incorporated by reference.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Reducing Agents

According to a tenth aspect of the substantially light-insensitive thermographic recording material, according to the present invention, the organic reducing agent for the reduction of the substantially light-insensitive organic silver salt is an organic compound containing at least one active hydrogen atom linked to O, N or C, such as is the case with, aromatic di- and tri-hydroxy compounds.

According to an eleventh aspect of the substantially light-insensitive thermographic recording material, according to the present invention, the organic reducing agent is a 1,2-dihydroxybenzene derivative, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid ester.

According to a twelfth aspect of the substantially light-insensitive thermographic recording material, according to the present invention, the organic reducing agent is an organic reducing agent disclosed in EP-B 692 733, herein incorporated by reference, e.g. ethyl 3,4-dihydroxybenzoate and n-butyl 3,4-dihydroxybenzoate, According to a thirteenth aspect of the substantially light-insensitive thermographic recording material, according to the present invention, is an organic reducing agent disclosed in EP-A 903 625, herein incorporated by reference, e.g. 3,4-dihydroxybenzonitrile.

Combinations of reducing agents may also be used that on heating become reactive partners in the reduction of the substantially light-insensitive organic silver salt containing mixed crystals of two or more organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

According to a fourteenth aspect of the substantially light-insensitive thermographic recording material, according to the present invention, the binder is a natural, modified natural or synthetic resins or mixtures of such resins, in which the substantially light-insensitive organic silver salt can be homogeneously dispersed either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

According to a fifteenth aspect of the substantially light-insensitive thermographic recording material, according to the present invention, the binder is a water-soluble film-forming binder, for example: polyvinyl alcohol, polyacrylamide, polymethacrylamide, polyacrylic acid, polymethacrylic acid, polyvinylpyrrolidone, polyethyleneglycol, proteinaceous binders such as gelatine, modified gelatines such as phthaloyl gelatine, polysaccharides, such as starch, gum arabic and dextran and water-soluble cellulose derivatives.

According to a sixteenth aspect of the substantially light-insensitive thermographic recording material, according to the present invention, the binder is gelatin.

According to a seventeenth aspect of the substantially light-insensitive thermographic recording material, according to the present invention, the weight ratio of binder to substantially light-insensitive organic silver salt is in the range of 0.2 to 7.

According to an eighteenth aspect of the substantially light-insensitive thermographic recording material, according to the present invention, the thickness of the thermosensitive element is in the range of 5 to 50 μm.

According to a nineteenth aspect of the substantially light-insensitive thermographic recording material, according to the present invention, the binder does not contain additives or impurities which adversely affect the thermographic properties of the substantially thermographic recording material.

Toning Agent

According to a twentieth aspect of the substantially light-insensitive thermographic recording material, according to the present invention, the thermosensitive element further contains a toning agent in order to obtain a neutral black image tone in the higher densities and neutral grey in the lower densities.

According to a twenty-first aspect of the substantially light-insensitive thermographic recording material, according to the present invention, the thermosensitive element further contains at least one toning agent selected from the group consisting of phthalimides and phthalazinones. Suitable toning agents are the within the scope of the general formulae described in U.S. Pat. No. 4,082,901. Further reference is made to the toning agents described in U.S. Pat. Nos. 3,074,809, 3,446,648 and 3,844,797.

According to a twenty-second aspect of the substantially light-insensitive thermographic recording material, according to the present invention, the thermosensitive element contains at least one heterocyclic toning compounds of the benzoxazine dione or naphthoxazine dione type as disclosed in GB 1,439,478, U.S. Pat. No. 3,951,660, e.g. benzo[e][1,3]oxazine-2,4-dione and 7-methyl-benzo[e][1,3]oxazine-2,4-dione, and U.S. Pat. No. 5,599,647, e.g. 7-(ethylcarbonato)-benzo[e][1,3]oxazine-2,4-dione, herein incorporated by reference.

Antifoggants

According to twenty-third a aspect of the substantially light-insensitive thermographic recording material, according to the present invention, the substantially light-insensitive thermographic recording material further contains an antifoggant to obtain improved shelf-life and reduced fogging.

According to a twenty-fourth aspect of the substantially light-insensitive thermographic recording material, according to the present invention, the substantially light-insensitive thermographic recording material further contains at least one antifoggant selected from the group consisting of benzotriazole, substituted benzotriazoles, tetrazoles, mercaptotetrazoles such as 1-phenyl-5-mercaptotetrazole, and aromatic polycarboxylic acids such as orthophthalic acid, 3-nitro-phthalic acid, tetrachlorophthalic acid, mellitic acid, pyromellitic acid and trimellitic acid, and anhydrides thereof.

Polycarboxylic Acids and Anhydrides Thereof

According to a twenty-fifth aspect of the substantially light-insensitive thermographic recording material, according to the present invention, the thermosensitive element further comprises at least one polycarboxylic acid and/or anhydride thereof in a molar percentage of at least 15 with respect to all the organic silver salt(s) present and in thermal working relationship therewith.

According to a twenty-sixth aspect of the substantially light-insensitive thermographic recording material, according to the present invention, the thermosensitive element further comprises at least one aliphatic (saturated as well as unsaturated aliphatic and also cycloaliphatic) or aromatic polycarboxylic acid, optionally substituted and optionally used in anhydride form or partially esterified form on the condition that at least two free carboxylic acids remain or are available in the heat recording step.

Surfactants and Dispersion Agents

Surfactants and dispersants aid the dispersion of ingredients or reactants which are insoluble in the particular dispersion medium.

According to a twenty-seventh aspect of the substantially light-insensitive thermographic recording material, according to the present invention, the substantially light-insensitive thermographic recording material further comprises one or more surfactants, which may be anionic, non-ionic or cationic surfactants, and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

Support

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a twenty-eighth aspect of the substantially light-insensitive thermographic recording material, according to the present invention, the thermosensitive element is provided with a protective layer to avoid local deformation of the thermosensitive element and to improve resistance against abrasion.

According to a twenty-ninth aspect of the substantially light-insensitive thermographic recording material, according to the present invention, the thermosensitive element is provided with a protective layer comprising a binder, which may be solvent-soluble, solvent-dispersible, water-soluble or water- dispersible.

According to a thirtieth aspect of the substantially light-insensitive thermographic recording material, according to the present invention, the thermosensitive element is provided with a protective layer comprising a solvent-soluble polycarbonate binder as described in EP-A 614 769, herein incorporated by reference.

According to a thirty-first aspect of the substantially light-insensitive thermographic recording material, according to the present invention, the thermosensitive element is provided with a protective layer comprising a water-soluble or water-dispersible binders, as coating can be performed from an aqueous composition and mixing of the protective layer with the immediate underlayer can be avoided by using a solvent-soluble or solvent-dispersible binder in the immediate underlayer.

According to a thirty-second aspect of the substantially light-insensitive thermographic recording material, according to the present invention, the thermosensitive element is provided with a crosslinked protective layer.

According to a thirty-third aspect of the substantially light-insensitive thermographic recording material, according to the present invention, the thermosensitive element is provided with a protective layer crosslinked with crosslinking agents such as described in WO 95/12495, herein incorporated by reference.

According to a thirty-fourth aspect of the substantially light-insensitive thermographic recording material, according to the present invention, the thermosensitive element is provided with a protective layer comprising solid or liquid lubricants or combinations thereof for improving the slip characteristics of the substantially light-insensitive thermographic recording material.

According to a thirty-fifth aspect of the substantially light-insensitive thermographic recording material, according to the present invention, the thermosensitive element is provided with a protective layer comprising thermomeltable particles as solid lubricants are thermomeltable particles, such as those described in WO 94/11199, herein incorporated by reference.

According to a thirty-sixth aspect of the substantially light-insensitive thermographic recording material, according to the present invention, the thermosensitive element is provided with a protective layer comprising a matting agent, such as described in WO 94/11198, herein incorporated by reference, e.g. talc particles, which optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the invention and comparative examples, are:

organic silver salts:
- AgB=silver behenate;

the reducing agent:
- R01=ethyl 3,4-dihydroxybenzoate;
- R02=3,4-dihydroxybenzonitrile;

the binders:
- K17881=type 17881, a gelatin with low potassium ion, sodium ion and chloride-ion concentrations from AGFA-GEVAERT GELATINEFABRIEK vorm. KOEPFF & SÖHNE;
- R16875=type 16875, a phthaloyl-gelatin from Rousselot;
- LATEX01=a copolymer consisting of 54.25 wt. % styrene, 43.25 wt. % butyl acrylate and 2.5 wt. % potassium salt of N-[(4'-sulfobenzamido)-oxo-decyl] methacrylamide;

S01=1-phenyl-5-mercapto-tetrazole;

the toning agents:
- T01=7-(ethylcarbonato)-benzo[e][1,3]oxazine-2,4-dione;
- T02=phthalazinone.

stabilizers according to U.S. Pat. No. 5,672,560:
- RU01=

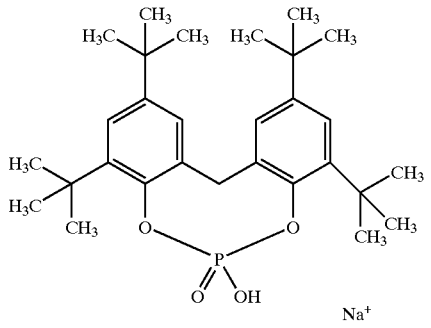

RU02=$Na_3PO_4$;
RU03=bis(2-ethylhexyl)hydrogen phosphate

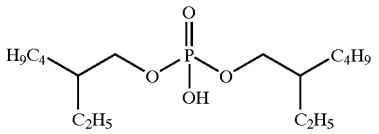

Surfactant Nr. 1=MARLON™ A-365, supplied as a 65% concentrate of a sodium alkyl-phenylsulfonate by H ÜLS;

Surfactant Nr. 2=MARLON™ AS3, supplied as a 98% concentrate of an alkylphenylsulfonic acid by HÜLS.

COMPARATIVE EXAMPLES 1 to 4 and INVENTION EXAMPLES 1 to 3

Comparison of the image tone stability of prints of thermographic materials according to U.S. Pat. No. 5,672,560 with that of thermographic materials according to present invention Preparation of Silver Behenate Dispersions The silver behenate dispersion was produced as follows: 25 kg (73.5M) behenic acid was dispersed with stirring at 80° C. in 100L of a 10% solution of Surfactant Nr. 1 per g behenic acid made up to 250L with deionized water at a temperature of 80° C.; then 36.75L of a 2M aqueous solution of sodium hydroxide was added over a period of 10 to 20 minutes to give a clear solution substantially containing sodium behenate; then 25L of a 2.94M aqueous solution of silver nitrate was added with stirring at a rate of 0.163 moles/moles silver behenate.min to convert the sodium behenate completely into silver behenate; and finally ultrafiltration was carried out with a 500000 MW polysulfone cartridge filter at room temperature to concentrate the resulting silver behenate dispersion while adding ammonium nitrate to convert Surfactant Nr 1 into its ammonium salt, the final AgBeh-concentration was 20.4% with 0.062 g of ammonium alkyl-phenylsulfonate/g AgBeh, the residual conductivity was 1.0 mS/cm.

Preparation of Thermographic Recording Materials

The coating dispersion for the thermosensitive element was produced by first allowing 3.44 g of K17881 to swell in 16.33 g of deionized water over a period of 30 minutes. 3.05 g of a first aqueous toning agent dispersion containing 18.08% of T01 and 9.95% of K17881 and 0.8 g of a second toning agent dispersion containing 20.12% of T02 and 8.88% of R16875 were then added and the resulting dispersion heated with stirring up to 50° C. 2 g of the above-mentioned dispersion of silver behenate were then added and after 10 minutes stirring a further 22.2 g of the same silver behenate dispersion were added and the resulting dispersion stirred for a further 10 minutes before 3.955 g of a 25.28% dispersion of LATEX01 was added. After a further 10 minutes stirring 2.222 g of 5.9% polyitaconic acid in water was added and after a further 10 minutes stirring, the resulting dispersion was cooled to 36° C. Finally 18 g of deionized water was added in the case of COMPARATIVE EXAMPLE 1 or quantities or solutions or dispersions of the different stabilizers according to U.S. Pat. No. 5,672,560 and the image stabilizing agents according to the present invention to produce a concentration of 10 mol % with respect to silver behenate made up to 18 g with deionized water were added in the cases of COMPARATIVE EXAMPLES 2 to 4 and INVENTION EXAMPLES 1 and 2 (see Table 1 for method of addition) and the dispersion stirred for a further 15 minutes. Shortly before coating 6 g of an aqueous ethanol solution containing 9.909% of R02 and 4.9% of S01 was added with stirring.

This coating dispersion at a temperature of 36° C. was then doctor-blade coated onto the non-backing layer side of a subbed 168 μm thick blue-pigmented polyethylene terephthalate support with a backing layer (optical density upon measurement with a MACBETH™ TR924 densitometer through visible and blue filters in transmission of subbed support with backing layer was 0.19 and 0.05 respectively) to a wet coating weight of 72 g/m$^2$ and while undried was overcoated with 11 g/m$^2$ of an aqueous solution with 1.8% by weight of 1,1-bis(vinylsulfono)methane and 0.9091% by weight of Surfactant Nr. 1. Upon drying, the thermosensitive elements of COMPARATIVE EXAMPLES 1 to 4 and INVENTION EXAMPLES 1 and 2 were obtained.

TABLE 1

| | AgB g/m$^2$ | Image tone stabilizer type | mol % vs AgB | Added as |
|---|---|---|---|---|
| Comparative example nr | | | | |
| 1 | 4.847 | — | — | — |
| 2 | 4.768 | RU01 | 10 | Aqueous dispersion of 8.46% RU01; 7.45% K17881 & 0.6% Surfactant Nr. 2 |
| 3 | 4.820 | RU02 | 10 | 10% aqueous solution at pH 10.5 |
| 4 | 4.820 | RU03 | 10 | 10% aqueous solution at pH 5.7 |
| Invention example nr | | | | |
| 1 | 5.321 | ITS-1 | 10 | 5% aqueous solution at pH 5.03 |
| 2 | 5.005 | ITS-2 | 10 | aqueous dispersion of 8.168% ITS-2 & 7.188% K17881 |

Thermographic Printing

During the thermographic printing of the substantially light-insensitive thermographic recording materials of COMPARATIVE EXAMPLES 1 to 4 and INVENTION EXAMPLES 1 and 2, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The DRYSTAR® 2000 printer from AGFA-GEVAERT was equipped with a thin film thermal head with a resolution of 300 dpi and was operated with a line time of 11.8 ms (the line time being the time needed for printing one line). During this line time the print head received constant power. The printing power was 90 mW and the thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 2.

Image Evaluation

The image tone of fresh prints made with the substantially light-insensitive thermographic recording materials of COMPARATIVE EXAMPLES 1 to 4 and INVENTION EXAMPLES 1 and 2 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the substantially light-insensitive thermographic recording materials of COMPARATIVE EXAMPLES 1 to 4 and INVENTION EXAMPLES 1 and 2 at optical densities, D, of 1.0 are also given in Table 2 and with the exception of the thermographic recording material of COMPARATIVE EXAMPLE 1 represent acceptable values. The $D_{min}$ values are mainly due to the density of the support, which had a $D_{vis}$ value of 0.19.

TABLE 2

| | AgB [g/m²] | Image tone stabilizer | Print with fresh material $D_{max}$ vis | Print with fresh material $D_{min}$ vis | CIELAB-values for print with fresh material for D = 1 a* | CIELAB-values for print with fresh material for D = 1 b* |
|---|---|---|---|---|---|---|
| Comparative example number | | | | | | |
| 1 | 4.847 | — | 3.30 | 0.21 | −3.11 | −4.37 |
| 2 | 4.768 | RU01 | 3.24 | 0.22 | −3.63 | −2.45 |
| 3 | 4.820 | RU02 | 2.98 | 0.21 | −1.07 | −6.51 |
| 4 | 4.820 | RU03 | 2.40 | 0.21 | −2.43 | −7.31 |
| Invention example nr | | | | | | |
| 1 | 5.321 | ITS-1 | 2.63 | 0.21 | −0.70 | −8.34 |
| 2 | 5.005 | ITS-2 | 2.90 | 0.22 | −2.98 | −6.11 |

Shelf-life Tests

Simulated long-term shelf-life tests were performed by heating fresh thermographic recording materials of COMPARATIVE EXAMPLES 1 to 4 and INVENTION EXAMPLES 1 to 2 at 45° C. in 70% relative humidity in the dark for 3 and 7 days respectively before printing. Prints with these materials were evaluated as described above for prints of the corresponding fresh thermographic recording materials and the results are given in Table 3.

TABLE 3

| | Image tone stabilizer | Print of material after 7d 45° C./70% RH $D_{max}$ vis | Print of material after 7d 45° C./70% RH $D_{min}$ vis | CIELAB-values for print of material for D = 1 after 7d at 45° C./70% RH a* after 3d | CIELAB-values for print of material for D = 1 after 7d at 45° C./70% RH a* after 7d | Δa* CIELAB-values for D = 1 versus freshly printed material after period at 45° C./70% RH after 3d | Δa* CIELAB-values for D = 1 versus freshly printed material after period at 45° C./70% RH from 3d to 7d | Δa* CIELAB-values for D = 1 versus freshly printed material after period at 45° C./70% RH after 7d |
|---|---|---|---|---|---|---|---|---|
| Comparative Example number | | | | | | | | |
| 1 | — | 4.00 | 0.20 | −4.81 | −7.5 | −1.70 | −2.69 | −4.39 |
| 2 | RU01 | 4.15 | 0.24 | −4.84 | −6.74 | −2.21 | −1.90 | −3.11 |
| 3 | RU02 | 3.61 | 0.21 | −1.75 | −2.86 | −0.68 | −1.11 | −1.79 |
| 4 | RU03 | 4.35 | 0.22 | −4.08 | −5.48 | −1.65 | −1.40 | −3.05 |
| Invention example nr | | | | | | | | |
| 1 | ITS-1 | 3.44 | 0.21 | −1.21 | −2.2 | −0.51 | −0.99 | −1.50 |
| 2 | ITS-2 | 4.01 | 0.23 | −4.35 | −5.21 | −1.37 | −0.86 | −2.23 |

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density and variation in a*-values has a greater impact than variation in b*-values.

Shelf-life performance was evaluated by comparing the change in a* CIELAB values for d=1.0 between prints produced with a sheet of the thermographic recording material subjected to heating in the dark for 3 days at 45° C. and 70% relative humidity and a sheet which has been subjected to heating in the dark for a further 4 days at 45° C. and 70% relative humidity i.e. 7 days in all at 45° C. and 70% relative humidity. More acceptable shelf-life behaviour is represented by lower Δa* CIELAB values at D=1.

Table 3 shows that the shifts in the CIELAB a* value, Δa*, for D=1.0 for prints of the substantially light-insensitive thermographic recording materials of INVENTION EXAMPLES 1 and 2 according to the present invention after 3 days, between 3 and 7 days and after 7 days at 45° C. and 70% relative humidity prior to printing were significantly lower for the substantially light-insensitive thermographic recording materials of INVENTION EXAMPLES 1 and 2 than for the substantially light-insensitive thermographic recording materials of COMPARATIVE EXAMPLES 1, 2 and 4 either containing no stabilizing compound or containing stabilizing compounds according to U.S. Pat. No. 5,672,560.

The Δa* values for D=1.0 after 3 days and 7 days at 45° C. and 70% relative humidity prior to printing for the substantially light-insensitive thermographic recording material of COMPARATIVE EXAMPLE 3 containing another stabilizing compound according to U.S. Pat. No. 5,672,560 were intermediate between the Δa* values for D=1.0 for the substantially light-insensitive thermographic recording materials of INVENTION EXAMPLES 1 and 2 and the Δa* values for D=1.0 between 3 and 7 days was higher than those for the substantially light-insensitive thermographic recording materials of INVENTION EXAMPLES 1 and 2.

Archivability Tests

Simulated long-term archivability tests were performed by heating prints produced with thermographic recording materials of COMPARATIVE EXAMPLES 1 to 4 and INVENTION EXAMPLES 1 and 2, which had been subjected to heating at 45° C. in 70% relative humidity in the dark for 7 days prior to printing, for 4 days in the dark at 45° C. and 70% relative humidity. The prints were then evaluated as described above for prints of the corresponding fresh thermographic recording materials and the results are given in Table 4.

Archival performance was assessed by monitoring the changes in a* and b* CIELAB values at D=1 of a print produced with a sheet of thermographic recording material, which had been heated in the dark for 7 days at 45° C. and 70% relative humidity prior to printing, over 4 days in the dark at 45° C. and 70% relative humidity. More acceptable shelf-life behaviour is represented by lower Δa* and Δb* CIELAB values at D=1.

TABLE 4

| | Image tone stabilizer | Print # after 4d 45°/70% RH $D_{max}$ vis | $D_{min}$ Vis | CIELAB-values for print # after 4d 45° C./70% RH for D = 1 a* | b* | ΔCIELAB-values versus fresh print # for D = 1 Δa* | Δb* |
|---|---|---|---|---|---|---|---|
| Comparative example Number | | | | | | | |
| 1 | — | 4.13 | 0.20 | −3.27 | −1.22 | +4.23 | −1.97 |
| 2 | RU01 | 3.96 | 0.22 | −4.68 | −1.41 | +2.06 | −3.12 |
| 3 | RU02 | 3.56 | 0.20 | +4.19 | +8.93 | +7.05 | +12.99 |
| 4 | RU03 | 4.29 | 0.20 | +8.05 | +8.91 | +13.53 | +9.35 |
| Invention example nr | | | | | | | |
| 1 | ITS-1 | 3.35 | 0.20 | −1.35 | −2.85 | +0.85 | +1.33 |
| 2 | ITS-2 | 3.91 | 0.22 | −2.31 | −1.68 | +2.90 | +0.10 |

# material subjected to 7d at 45° C./70% RH prior to printing

In evaluating the performance of the substantially light-insensitive thermographic recording materials of COMPARATIVE EXAMPLES 1 to 4 and INVENTION EXAMPLES 1 and 2, it is the overall performance of the materials that is important. Therefore, assuming acceptable image tone neutrality, good shelf-life behaviour in the absence of good archival properties is equally as prohibitive as good archival properties in the absence of good shelf-life behaviour i.e. in assessing performance the degree of image tone neutrality, the shelf-life behaviour and the archival behaviour have all to be taken into consideration.

It is notable that the substantially light-insensitive thermographic recording material of COMPARATIVE EXAMPLE 3, incorporating a stabilizer according to U.S. Pat. No. 5,672,560, which exhibited shelf-life behaviour broadly similar to that observed with the substantially light-insensitive thermographic recording materials of INVENTION EXAMPLES 1 and 2, exhibited very poor archival properties as indicated by the very high Δa*- and Δb*-values.

On the other hand the substantially light-insensitive thermographic recording material of COMPARATIVE EXAMPLE 2, incorporating a stabilizer according to U.S. Pat. No. 5,672,560, which exhibited archival behaviour broadly similar to that observed with the substantially light-insensitive thermographic recording materials of INVENTION EXAMPLES 1 and 2, exhibited very poor shelf-life properties as indicated by the very Δa*-values.

The substantially light-insensitive thermographic recording material of COMPARATIVE EXAMPLES 1 and 4, not incorporating a stabilizer and incorporating a stabilizer according to U.S. Pat. No. 5,672,560 respectively, exhibited both poor shelf-life behaviour as evidenced by the high Δa*-values and poor archival properties as indicated by the high Δa*- and Δb*-values.

In conclusion thermographic recording materials incorporating the image tone stabilizing compounds according to formula (I) exhibit both improved shelf-life image tone stability and improved archival image tone stability, which is not available if the stabilizer compounds taught by U.S. Pat. No. 5,672,560 or other image tone stabilizers are used. The stabilizer compounds taught by U.S. Pat. No. 5,672,560 may produce one or other beneficial effect, but are unable to provide the mix of image tone stabilizing effects required by thermographic recording materials for medical imaging and graphics imaging purposes and provided by the compounds according to formula (I) of the present invention.

Having described in detail preferred embodiments of the current invention, it will now be apparent to those skilled in the art that numerous modifications can be made therein without departing from the scope of the invention as defined in the following claims.

We claim:

1. A substantially light-insensitive black and white thermographic recording material comprising a thermosensitive element and a support, said thermosensitive element containing at least one substantially light-insensitive organic silver salt, an organic reducing agent therefor in thermal working relationship therewith, an image tone stabilizer and a binder, wherein said image tone stabilizer is a compound according to formula (I):

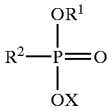

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group;

$R^2$ is an optionally substituted alkyl, cycloalkyl, heterocyclic, alkaryl, aralkyl, heteroaryl or aryl group; or $R^1$ and $R^2$ together represent the atoms necessary to form a ring structure; and X is hydrogen, an alkali metal ion, an ammonium ion, a phosphonium ion, a sulphonium ion or an alkaline earth ion.

2. Thermographic recording material according to claim 1, wherein said thermosensitive element further contains a toning agent.

3. Thermographic recording material according to claim 2, wherein said toning agent is phthalazinone, a phthalazinone derivative, pyridazone, a pyridazone derivative, a benzoxazine derivative or a substituted benzoxazine derivative.

4. Thermographic recording material according to claim 1, wherein said stabilizer compound is a compound according to formula (I) with the following structure:

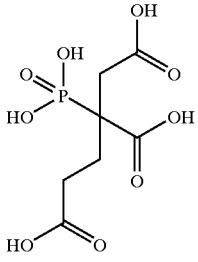

$(NH_4^+)$

5. Thermographic recording material according to claim 1, wherein said stabilizer compound is a compound according to formula (I) with the following structure:

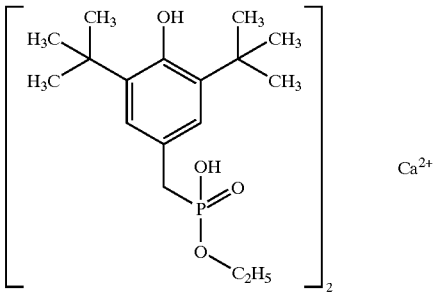

6. A recording process comprising the steps of:

(i) bringing an outermost layer of a thermographic recording material according to claim 1 into proximity with a heat source;

(ii) applying heat from said heat source imagewise to said thermographic recording material in a substantially water-free condition while maintaining proximity to said heat source to produce an image; and (iii) removing said thermographic recording material from said heat source.

7. Recording process according to claim 6, wherein said heat source is a thin film thermal head.

8. Process for using a compound according to formula (I):

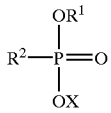

(I)

wherein $R^1$ is hydrogen, an alkali metal ion, an ammonium ion, a phosphonium ion, a sulphonium ion, an alkaline earth ion or an optionally substituted alkyl, cycloalkyl, heterocyclic, alkaryl, aralkyl, heteroaryl or aryl group;

$R^2$ is an optionally substituted alkyl, cycloalkyl, heterocyclic, alkaryl, aralkyl, heteroaryl or aryl group;

or $R^1$ and $R^2$ together represent the atoms necessary to form a ring structure; and X is hydrogen, an alkali metal ion, an ammonium ion, a phosphonium ion, a sulphonium ion or an alkaline earth ion;

in a substantially light-insensitive thermographic recording material as an image tone stabilizer, comprising the steps of:

providing said substantially light-insensitive thermographic recording material comprising a support and a thermosensitive element, said thermosensitive element containing at least one substantially light-insensitive organic silver salt, an organic reducing agent therefor in thermal working relationship therewith, said compound according to formula (I) and a binder; and imagewise-applying heat to said substantially light-insensitive thermographic recording material.

* * * * *